United States Patent [19]

Black

[11] Patent Number: 4,938,712

[45] Date of Patent: Jul. 3, 1990

[54] JUMPER CABLES

[76] Inventor: Andrew B. Black, 210 Birkdale Road, Scarborough, Ontario, Canada, M1P 3S2

[21] Appl. No.: 388,845

[22] Filed: Aug. 3, 1989

[51] Int. Cl.[5] ..... H01R 11/00

[52] U.S. Cl. ..... 439/490; 439/504; 320/25; 320/48; 340/636

[58] Field of Search ..... 439/489, 488, 490, 504; 320/25, 26, 48; 324/133; 340/636

[56] References Cited

U.S. PATENT DOCUMENTS

| | | | |
|---|---|---|---|
| 3,259,754 | 7/1966 | Matheson | 439/504 |
| 3,936,121 | 2/1976 | Leinberger | 439/504 |
| 4,145,648 | 3/1979 | Zender | 439/504 |
| 4,272,142 | 6/1981 | Zapf | 439/504 |
| 4,420,212 | 12/1983 | Wright | 439/504 |
| 4,488,147 | 12/1984 | Signorile | 439/504 |
| 4,840,583 | 6/1989 | Moore | 439/504 |

FOREIGN PATENT DOCUMENTS 961823 1/1975 Canada .

*Primary Examiner*—Gary F. Paumen
*Attorney, Agent, or Firm*—Arne I. Fors

[57] ABSTRACT

A pair of improved jumper cables one end of which automatically lights when the other is arbitrarily connected to a source battery and also automatically indicates the polarity of the source battery by means of light emitting diodes. Also when a pair of probes at the lighted end is arbitrarily connected to the destination battery, the polarity of the destination battery is automatically indicated by means of light emitting diodes. The polarities of the source battery and the destination battery are displayed together on the face of one of the clamps at the lighted end. By a comparison of the indicated polarities the correct connection can be made.

9 Claims, 2 Drawing Sheets

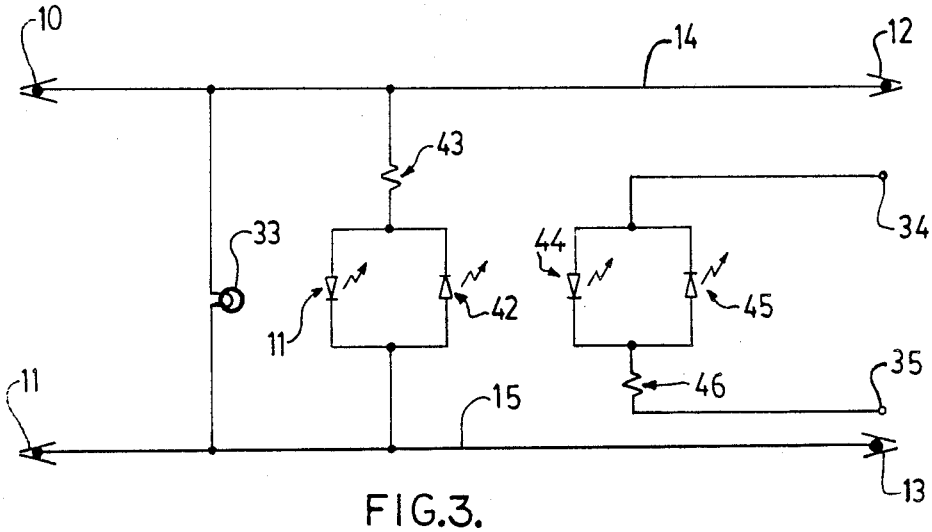
FIG.3.
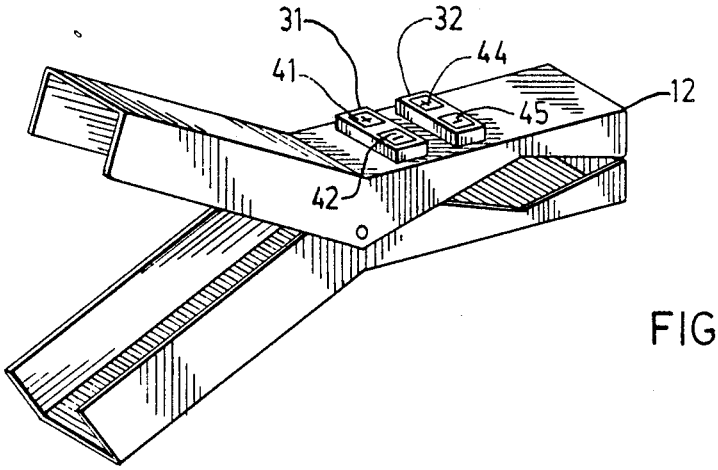
FIG.4.
FIG.5.
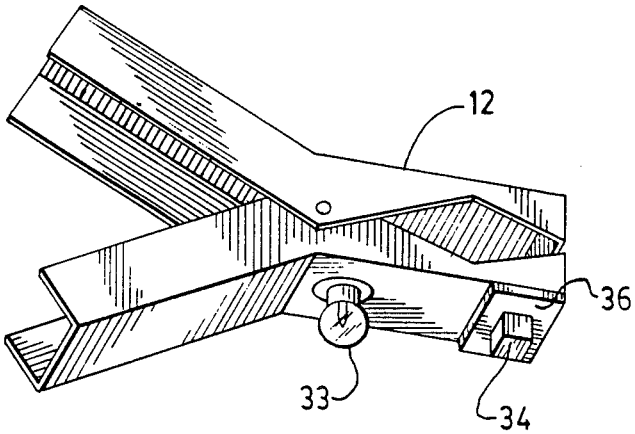

JUMPER CABLES

BACKGROUND OF THE INVENTION

The instant invention relates generally to battery jumper cables and more specifically to jumper cables which will help illuminate the area where they are connected, while at the same time indicate the proper connection polarity.

Numerous battery jumper cables have been provided in the prior art that are adapted to indicate proper connection polarity or illuminate the work area. For example U.S. Pat. Nos. 3,259,754; 4,272,142; 4,420,212; 4,488,147 and Canadian Pat. No. 961823 are all illustrative of such prior art. While these units may be suitable for the particular purpose to which they address, they would not be suitable for the purposes of the present invention as hereafter described.

SUMMARY OF THE INVENTION

A primary object of the present invention is to provide a pair of battery jumper cables that will overcome the shortcomings of the prior art devices.

Another object is to provide a pair of battery cables which indicate the correct choice of connection so that the destination battery will charge and not short out the source battery.

A further object is to provide a pair of battery jumper cables that is simple and easy to use.

A still further object is to provide a pair of battery jumper cables that is economical in cost to manufacture.

Further objects of the invention will appear as the description proceeds.

For the accomplishment of the above and related objects, this invention may be embodied in the form illustrated in the accompanying drawings, attention being called to the fact however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 3 is a schematic circuit diagram of the invention.

FIG. 4 is an enlarged top perspective view of a typical alligator clamp with the instant invention incorporated therewith.

FIG. 5 is an enlarged bottom perspective view of a typical alligator clamp with the instant invention incorporated therewith.

DETAILED DESCRIPTION OF THE PREFERRED EMBODIMENTS

Figure 1:
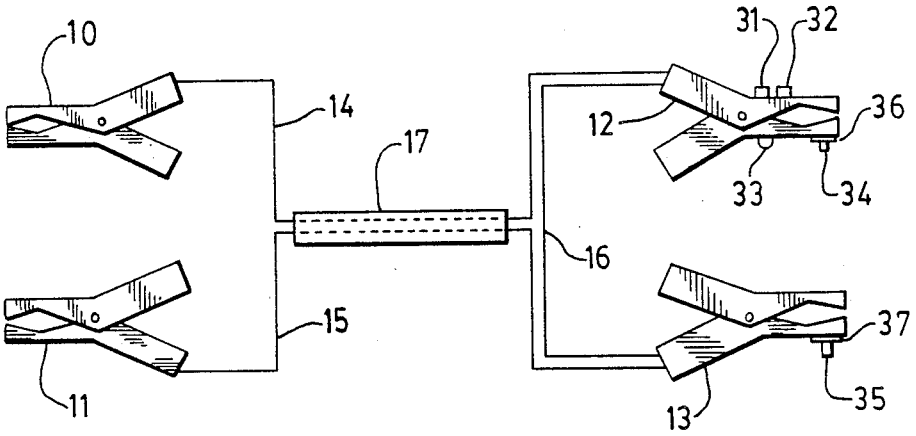
FIG. 1 is a top plan view of the invention.
Figure 2:
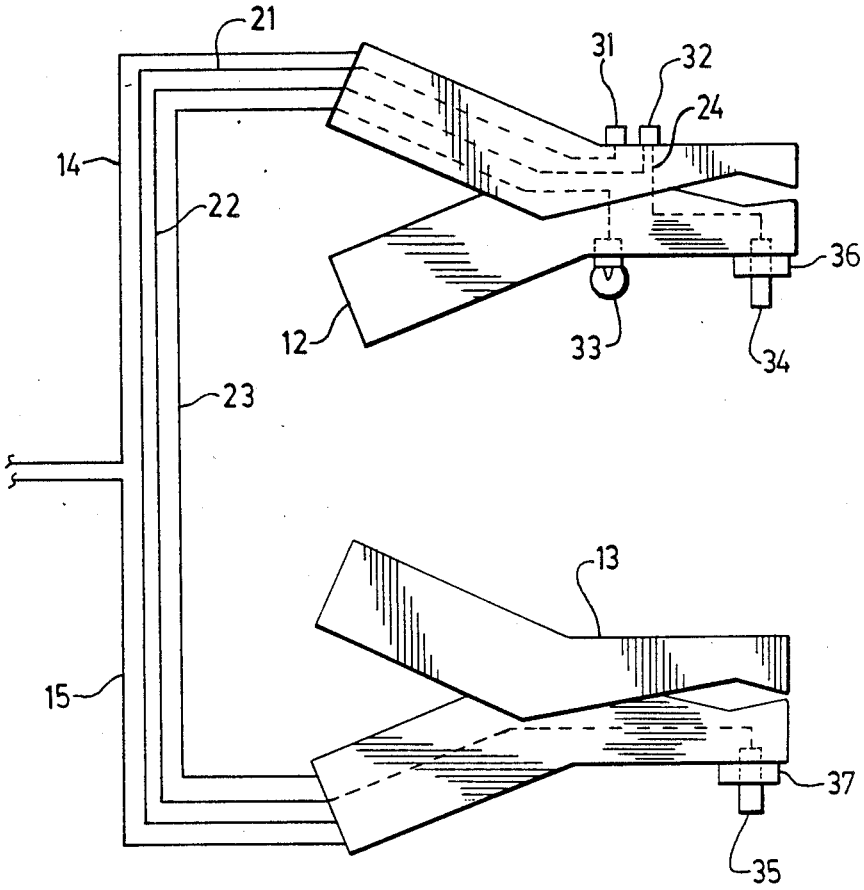
FIG. 2 is an enlarged top plan view of the receptor end of the invention.

Turning now descriptively to the drawings, in which like reference characters denote like elements throughout the several views, FIG. 1 illustrates a pair of battery jumper cables 14 and 15, housed in a single insulated sheath 17 incorporating the instant invention. Clamps 10 and 11 are connected to the donor battery (not shown) and clamps 12 and 13 are connected to the receptor battery (also not shown). Polarity indicators 31 and 32 are attached to the upper portion of clamp 12, also lamp 33 is attached to the lower portion of clamp 12. Probe 34 with shield 36 are attached to the lower lip of clamp 12, and probe 35 with shield 37 are attached to the lower lip of clamp 13. Probe 34 is electrically insulated from clamp 12, and probe 35 is electrically insulated from clamp 13. In FIG. 1 the single insulating sheath 16 contains the three cables 21, 22 and 23 as shown in FIG. 2. For the sake of simplicity single insulating sheath 16 is not shown in FIG. 2.

FIG. 2 is an enlarged view of the receptor clamps 12 and 13. Polarity indicator 31 is shown attached to clamp 12 . It is also electrically connected to clamp 12. Also cable 21 electrically connects polarity indicator 31 to clamp 13. Polarity indicator 32 is attached to clamp 12 and electrically connected to probe 34 by cable 24, and electrically connected to probe 35 by cable 22. Lamp 33 is attached to clamp 12, and electrically connected to it. Lamp 33 is also electrically connected to clamp 13 by means of cable 23.

In FIG. 1 it is shown that clamp 10 is electrically connected to clamp 12 by cable 14, and clamp 11 is electrically connected to clamp 13 by cable 15. So when clamps 10 and 11 are connected to the terminals of the donor battery clamps 12 and 13 will be electrically active. As lamp 33 is electrically connected to clamps 12 and 13 it will light and provide illumination of the receptor battery area. As the lamp is attached to the clamp, the clamp becomes an effective means for aiming and directing its light. Also polarity indicator 31 is electrically connected to both clamps 12 and 13, and so will indicate the polarity of the donor battery. Polarity indicator 32 is insulated from clamp 12, and will not be affected by the electrical state of clamps 12 and 13. Polarity indicator 32 is electrically connected to probes 34 and 35, so that when they are brought into contact with the terminals of the receptor battery it will indicate the polarity of the receptor battery. As both polarity indicators 31 and 32 are attached to the upper face of clamp 12, a ready comparison of the polarities of the donor and receptor batteries can be made and the correct connection to the terminals of the receptor determined. Also shields 36 and 37 which are attached respectively to clamps 12 and 13 protect against unintentional contact between the clamps and the battery terminals when the probes are being used.

FIG. 3 is an electrical circuit diagram of the embodiment of the invention. Battery clamp 10 is connected to clamp 12 by cable 14, and clamp 11 is connected to clamp 13 by cable 15. Lamp 33 is connected across cables 14 and 15. Polarity indicator 31 is shown connected across cables 14 and 15, and is comprised of two light emitting diodes (led) 41 and 42 back to back in parallel. This combination is connected in series with resistor 43. It can be seen from FIG. 3 that if the clamp 10 is connected to the positive terminal of the source battery and clamp 11 to the negative terminal, led 41 will light but led 42 will not and this can be used to determine the polarity of the polarity of the source battery as demonstrated in FIG. 4.

FIG. 4 is the enlarged view of the upper face of clamp 12. Here polarity indicator 31 is shown comprised of leds 41 and 42. Leds 41 and 42 are shown respectively as the plus and minus signs they illuminate. If clamp 10 is connected to the positive terminal of the battery, then led 41 will illuminate the plus sign indicating that clamp 12 is positive. If clamp 11 is connected to the positive terminal of the battery, then led 42 will illuminate the minus sign indicating that clamp 12 is negative.

FIG. 3 also shows the circuit diagram for polarity indicator 32, which is comprised of leds 44 and 45 connected back to back in parallel. This combination is connected in series with resistor 46. If probe 34 is connected to the posistive terminal of the receptor battery and probe 35 to the negative terminal, then led 44 will light and led 45 will not, and this can be used to determine the polarity of the receptor battery as shown in FIG. 4. Leds 44 and 45 are used respectively to illuminate the plus and minus signs of polarity indicator 32. When probe 34 is connected to the positive terminal of the battery, led 44 will illuminate the plus sign of polarity indicator 32, but if probe 35 is connected to the positive terminal of the battery, led 45 will illuminate the minus sign of polarity indicator 32.

FIG. 4 shows polarity indicators 31 and 32 attached to the upper face of clamp 12 in close proximity to each other, with their plus and minus signs opposite each other. The polarity of both the donor and receptor batteries will then be conveniently displayed on the upper face of the clamp. If the two plus signs are illuminated, or conversely the two minus signs, then the connection would be correct. However if a plus sign and a minus sign were illuminated then the connection would be incorrect.

FIG. 5 is an enlarged view of the lower face of clamp 12 showing the attachment of lamp 33 and shield 36 and probe 34.

I claim:

1. A battery jumper cable for polarized connection of a source battery to a destination battery, comprising:

(a) two insulated cables each having first and second ends, (b) battery attachment means at each end of said cables, (c) a first polarity indicating means at the second ends of one of the cables for indicating the polarity of the source battery when the first ends of said cables are arbitrarily connected thereto, (d) a first and second probe at the second ends of said cables and electrically insulated therefrom, and (e) a second polarity indicating means at the second end of one of said cables for indicating the polarity of said destination battery when said first and second probes are arbitrarily connected thereto prior to polarized connection of the second ends of the cables to the destination battery.

2. A battery jumper cable as claimed in claim 1 wherein said jumper cable further comprises a lamp integral with said battery attachment means at the second ends of said cables adapted for illumination when said first ends are connected to said source battery.

3. A battery jumper cable as claimed in claims 1 or 2 wherein said battery attachment means at the seconds ends of said cables comprises a clamp at each of said ends.

4. A battery jumper cable as claimed in claim 3 wherein said first probe is integral with one of said clamps but electrically insulated therefrom and said second probe is integral with the other of said clamps but electrically insulated therefrom.

5. A battery jumper cable as claimed in claim 4 wherein said first and second polarity indicating means are attached to one of said clamps.

6. A battery jumper cable as claimed in claim 5 wherein said first and second polarity indicating means comprises a pair of visual polarity sensitive devices connected parallel to each other and with their polarities opposed.

7. A battery jumper cable as claimed in claim 6 wherein said visual polarity sensitive devices have indicia thereof indicating the polarity for connecting the second ends of said jumper cables to said destination battery.

8. A battery jumper cable as recited in claim 7, wherein said visual polarity sensitive devices are light emitting diodes.

9. A battery jumper cable as recited in claim 7, wherein said visual polarity sensitive devices are liquid crystal diodes.

* * * * *